US008596519B2

(12) United States Patent
McClure

(10) Patent No.: US 8,596,519 B2
(45) Date of Patent: Dec. 3, 2013

(54) FRAME FACE DISPLAY AND SHIPPING CONTAINER

(75) Inventor: Jack A. McClure, Omaha, NE (US)

(73) Assignee: International Paper Company, Memphis, TN (US)

( * ) Notice: Subject to any disclaimer, the term of this patent is extended or adjusted under 35 U.S.C. 154(b) by 498 days.

(21) Appl. No.: 12/960,986

(22) Filed: Dec. 6, 2010

(65) Prior Publication Data

US 2012/0080426 A1 Apr. 5, 2012

Related U.S. Application Data

(60) Provisional application No. 61/388,933, filed on Oct. 1, 2010.

(51) Int. Cl.
*B65D 5/10* (2006.01)
*B65D 5/12* (2006.01)
*B65D 5/468* (2006.01)

(52) U.S. Cl.
USPC . 229/122; 206/772; 229/117.16; 229/125.28; 229/149; 229/160; 229/168

(58) Field of Classification Search
USPC ..... 229/117.16, 122, 125.17, 125.28, 131, 229/143, 149, 152, 153, 154, 160, 168; 206/736, 772, 774
See application file for complete search history.

(56) References Cited

U.S. PATENT DOCUMENTS

| | | | | |
|---|---|---|---|---|
| 2,450,110 | A | 9/1948 | Brooks | |
| 2,589,045 | A * | 3/1952 | Brooks | 229/160 |
| 2,858,059 | A * | 10/1958 | Kitchell | 229/125.28 |
| 3,143,275 | A * | 8/1964 | Diggs | 229/168 |
| 3,511,432 | A * | 5/1970 | Gish | 229/168 |
| 3,670,949 | A * | 6/1972 | Galanes | 229/117.16 |
| 3,735,913 | A * | 5/1973 | Lueben | 229/120 |
| 3,869,077 | A * | 3/1975 | Tuura | 229/117.16 |
| 4,017,019 | A * | 4/1977 | Booth | 229/149 |
| 4,717,070 | A * | 1/1988 | Taub | 229/125.28 |
| 4,846,775 | A | 7/1989 | Herrin | |
| 5,385,292 | A * | 1/1995 | Labianca et al. | 229/120 |
| 6,135,347 | A * | 10/2000 | Mueller | 229/149 |
| 6,488,201 | B1 | 12/2002 | Van Eijndhoven et al. | |
| 7,806,313 | B2 | 10/2010 | Philips | |
| 2004/0069842 | A1 | 4/2004 | Boutin | |
| 2009/0277953 | A1 | 11/2009 | Mathieu et al. | |

FOREIGN PATENT DOCUMENTS

| | | |
|---|---|---|
| FR | 1358881 | 4/1964 |

* cited by examiner

*Primary Examiner* — Gary Elkins
(74) *Attorney, Agent, or Firm* — Matthew M. Eslami

(57) ABSTRACT

The present invention is directed to an open-top container for shipping and displaying products which comprises a plurality of side walls. Bottom wall flaps are foldably joined to bottom edges of the side walls and are folded inwardly therefrom into overlapping relationship with one another to form a bottom wall closure. A respective plurality of triangularly-shaped beams foldably joined to upper edges of the respective plurality of side walls. Each of the plurality of the triangularly-shaped beams is defined by a shoulder panel and a flange panel foldably joined to one another. A bumper sticker panel is foldably joined to upper edge of one of the plurality of side walls forming a partial top closure when the open-top container is in the shipping position and partially prevents products from falling out when the open-top container is in the displaying position.

14 Claims, 15 Drawing Sheets

FRAME FACE DISPLAY AND SHIPPING CONTAINER

CROSS REFERENCE TO RELATED APPLICATIONS

This application claims priority to US provisional patent application Ser. No. 61/388,933, filed on 1 Oct. 2010, which is hereby incorporated hereinto by reference as if fully restated herein.

FIELD OF THE INVENTION

The present invention relates generally to containers for storing, protecting and displaying products and more particularly, to a shipping container that is easily converted into a display container that permits access to and display of the products shipped and contained therein.

BACKGROUND OF THE INVENTION

The present invention is directed to a frame face display and shipping container that has dual use of shipping and display characteristic.

In shipping and displaying products, particularly in a retail setting, it is desirable to have a container which is easy to pack, sturdy and fully enclosed for protection of contents during storage and shipping, and also suitable for display at a retail site. For example, it is beneficial to have a container which allows a customer at a retail site to easily reach into the container and remove products for purchase. In such an application, it is desirable to have a printed area on the container which advertises or identifies the product. During storage and shipment of a container, it is important that a printed area be protected so that it remains attractive to the consumer at the retail location. Of course, the access opening through which a consumer can access the goods must also be closed during shipment and storage to prevent spilling of the product out of the container. Previously, the hand-set display container was a two-piece design; a heavy-weight glued-tube outer and a light-weight tight-fitting 3-sided flanged U-shaped paperboard that had to be hand-inserted. The problems with this design were that the outer tears easily during the removal of the front tear-out panel that left jagged edges and often partially unfolded, and the time or labor or expense to insert the U-shaped paperboard.

There have been attempts in the past to manufacture a one-piece displayable container using perforated tear out panels, but these approaches have encountered several problems. For example, the perforations in previous attempts at such a design are; generally unprotected and located in areas that are highly susceptible to damage during shipping. This susceptibility to damage has led to premature failure of the perforations or has resulted in the use of stronger perforations requiring excessive force or tools to open.

Further, a perforated window, in itself, does not provide protection to any outside surfaces of a container, resulting in the potential for unattractive packages at retail sites due to gouges or scuffing from the distribution environment. Other attempts at creating a useful one-piece displayable container have used complex geometric designs requiring special equipment to manufacture, erect, and fill.

Therefore, it is desirable to provide a container for the shipping and display of products which can be easily manufactured on standard manufacturing and erecting equipment, and which further provides for easy alteration for display upon reaching point of sale and for convenient consumer access to the container contents.

SUMMARY OF THE INVENTION

The invention is directed to a "Frame Face" or open top shipping and display container for bags of refrigerated poultry and the like products. The phrase "Frame Face" generally means that due to the structure of the opening of the container, the open-top container can be used to store and ship products as well as being able to be rotated 90 degrees so that the container can be used as a display container. The material-handling requirement dictated that the bags and the container be shipped flat on their back, and then rotated 90 degrees into display position with an open face; eliminating all common display design choices since they are strong only in the shipping position. The shipping and display container had to be 1) strong in shipping position 2) have an open shop-able front that could survive weeks with up to four other displays container stacked on top of it and 3) has to be fast and easy to use within the retail's restrictive production environment.

The advantages of the present invention, among others, are that the frame face display and shipping container resolves all the aforementioned problem herein above, while successfully addressing each of the material-handling requirements. It is a one-piece design in a heavy-weight cardboard grade, that is shipped either open-front or with an optional removable top plug panel. This combination of attributes delivers: 1) Good top-to-bottom compression in shipping position 2) An open shop-able (e.g., excellent display and access to product) front that eliminates most of the "free panels" that could come unfolded and look unsightly 3) A "Frame-Face" that augments product presentation, faster and easier setup and loading in customer's production. At the same time, the present invention eliminates 1) the easy damage that happens during removal of the front tear-out panel and accompanying fraying 2) the time, labor, and expense of inserting a custom U-shaped cardboard or paperboard.

The frame face display and shipping container design is useful especially for those products that are shipped in one position and rotated at 90 degrees to be used as display container, and is defined as a glued-tube structure with a customer-choice bottom closure like the RSC (regular slotted container) flaps illustrated and triangularly-shaped or delta-beam-creating panels at the side panels of the top (or, rather, "Front" when in the display position). The extreme ends of the triangularly-shaped or delta beam panels include friction-producing extensions so that, when first folded into folding position, the panels will stay there until some sort of catchment is applied. Reinforcement of the top panel is best accomplished by a third triangularly-shaped or delta-beam-creating set of panels, with triangular-shaped portions at each corner used to lock both top panel and the side panel deltas into position. The bottom of the frame face (still in display position) can have any of several profiles as defined hereinafter.

The frame face display and shipping container can be configured in several alternative fashions. A bumper-sticker panel can be either taped/glued closed or a latching strap can be used. Either of these embodiments can be used with a top plug panel. Another embodiment of the design substitutes the same delta-panel arrangement at the bottom as is used at the top for the "bumper-sticker" panel. One of the plurality of triangularly-shaped beams includes a pair of shoe-shaped latches foldably joined at lateral opposed ends thereof to lock the plurality of triangularly-shaped beams into their respective folding position.

Accordingly, one aspect of the present invention is directed to an open-top container for shipping and displaying products which comprises a plurality of side walls. Bottom wall flaps are foldably joined to bottom edges of the side walls and are folded inwardly therefrom into overlapping relationship with one another to form a bottom wall closure. A respective plurality of triangularly-shaped beams foldably joined to upper edges of the respective plurality of side walls. Each of the plurality of the triangularly-shaped beams is defined by a shoulder panel and a flange panel foldably joined to one another. A bumper sticker panel is foldably joined to upper edge of one of the plurality of side walls forming a partial top closure when the open-top container is in the shipping position and partially prevents products from falling out when the open-top container is in the displaying position.

A top plug panel is used to enclose the open-top container when the open-top container is in the shipping position. The top plug is defined by a central panel having an extension tab and pulling section formed on respective opposed longitudinal edges thereof. A pair of first detachable latch tabs extend outwardly from opposed lateral edges the central panel. The plurality of side walls further comprises a pair of handhold openings, each of which is formed in opposed plurality of side walls and each includes a hinge tab. The respective pair of first detachable latch tabs is engaged with the respective hinge tabs to securely hold the top plug onto the open-top container.

The plurality of side walls further comprises a pair of can-lock apertures, each of which having a second latch-tabs. The bumper sticker panel includes a pair of identical can-lock tabs, each of which is defined by a strap and an ear. Each of the pair of identical can-lock tabs is inserted into the respective can-lock apertures and locked therein by the respective second latch-tabs. The bumper sticker panel is attached to the shoulder panels when forming the partial top closure. The plurality of triangularly-shaped beams and the bumper sticker panel in a tandem arrangement provide a bearing surface for another open-top container to stacked on one another.

Another aspect of the present invention is directed to a shipping and displaying container formed from a one-piece unitary blank of material. The shipping and displaying container comprises a bottom wall, first and second side walls, first and second end walls which all foldably joint with one another. First and second triangularly-shaped beams are foldably joined to upper edges of the respective first and second end walls. Each of the first and second triangularly-shaped beams is defined by a shoulder panel and a flange panel foldably joined to one another. A third triangularly-shaped beam having a pair of shoe-shaped latches foldably joined to upper edge of the second side wall. The pair of shoe-shaped latches foldably joined at lateral opposed ends of the third triangularly-shaped beam to lock and hold the first, second, and the third triangularly-shaped beams into their respective folding position. A bumper sticker panel is foldably joined to upper edge of the first side wall forming a partial top closure when the container is in the shipping position and partially prevents products from falling out when the container is in the displaying position.

A further aspect of the present invention is directed to a blank for making an open-top container comprises a plurality of side wall panels foldably joined together along adjacent side edges. One of the plurality of side wall panels includes a foldably joined glue panel adapted to form the side walls in opposed relationship to one another in an open-top container erected from the blank. A plurality of bottom wall flap panels are foldably joined to bottom edges of the side wall panels, the bottom wall flap panels adapted to be folded inwardly to form a bottom wall closure in an open-top container erected from the blank. First cut lines form in two of the plurality of the side walls at respective upper edges thereof, defining first punch-out panels that can be pushed inwardly to form respective handhold openings. A plurality of top wall flap panels divided by traverse fold lines foldably joined to lateral edges of the plurality of the side walls. The plurality of top wall flap panels form into first, second, third triangularly-shaped beams, and a bumper sticker panel in a container erected from the blank. Additional cut lines form in the two of the plurality of the side walls, defining can-lock aperture punch-out panels contiguous with the first punch-out panels.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE INVENTION

Figure 1:
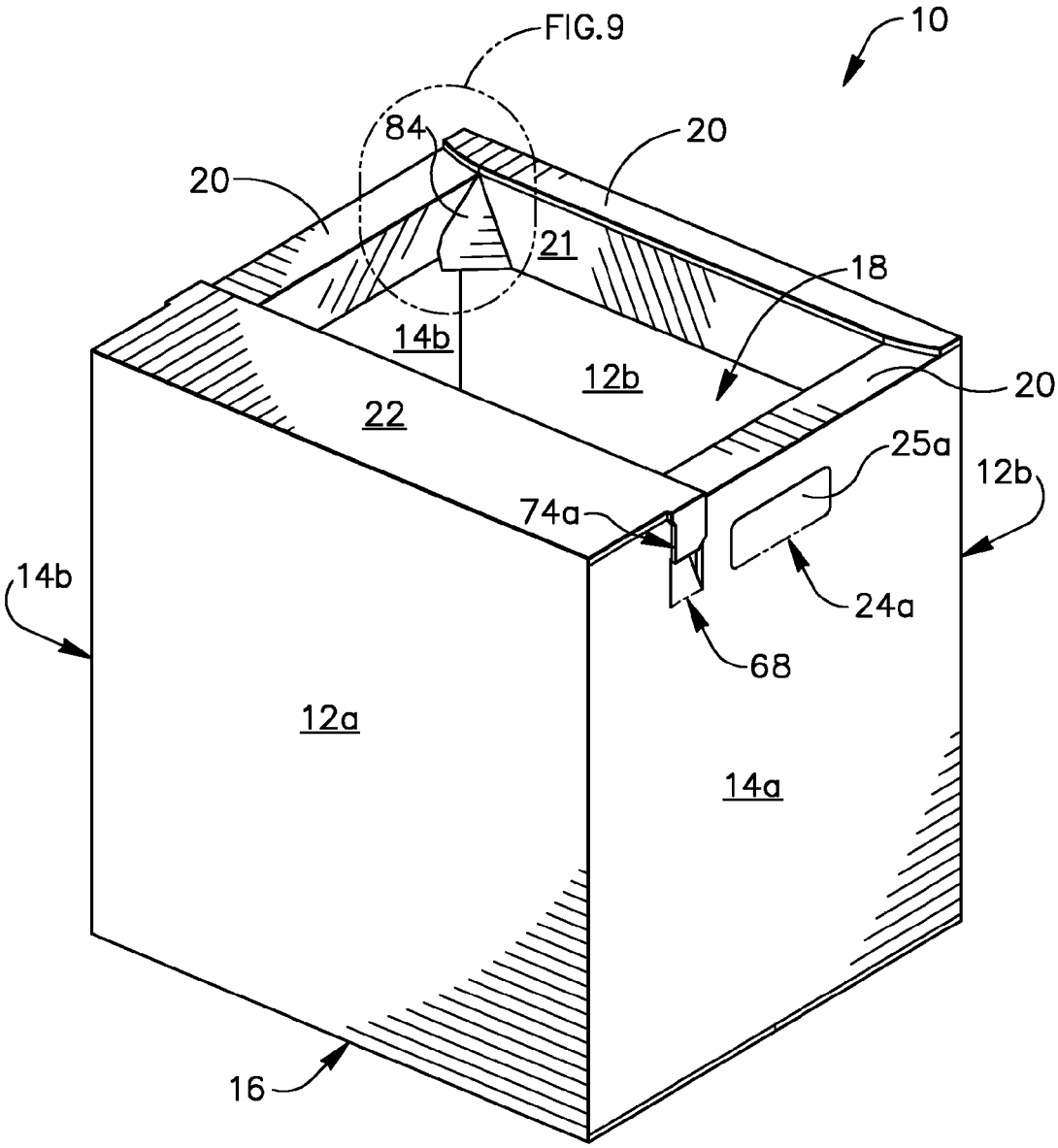
FIG. 1 is a top perspective view of a shipping and display container according to a first embodiment of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. In the present invention the use of prime character in the numeral references in the drawings directed to the different embodiment indicate that those elements are either the same or at least function the same or those elements are in the unfolded position. The phrase "Frame Face" generally means that due to the structure of the open-top container, the container can be used to store and ship products as well as being able to be rotated 90 degrees so that the open-top of the container can be used as a display container.

Figure 2:
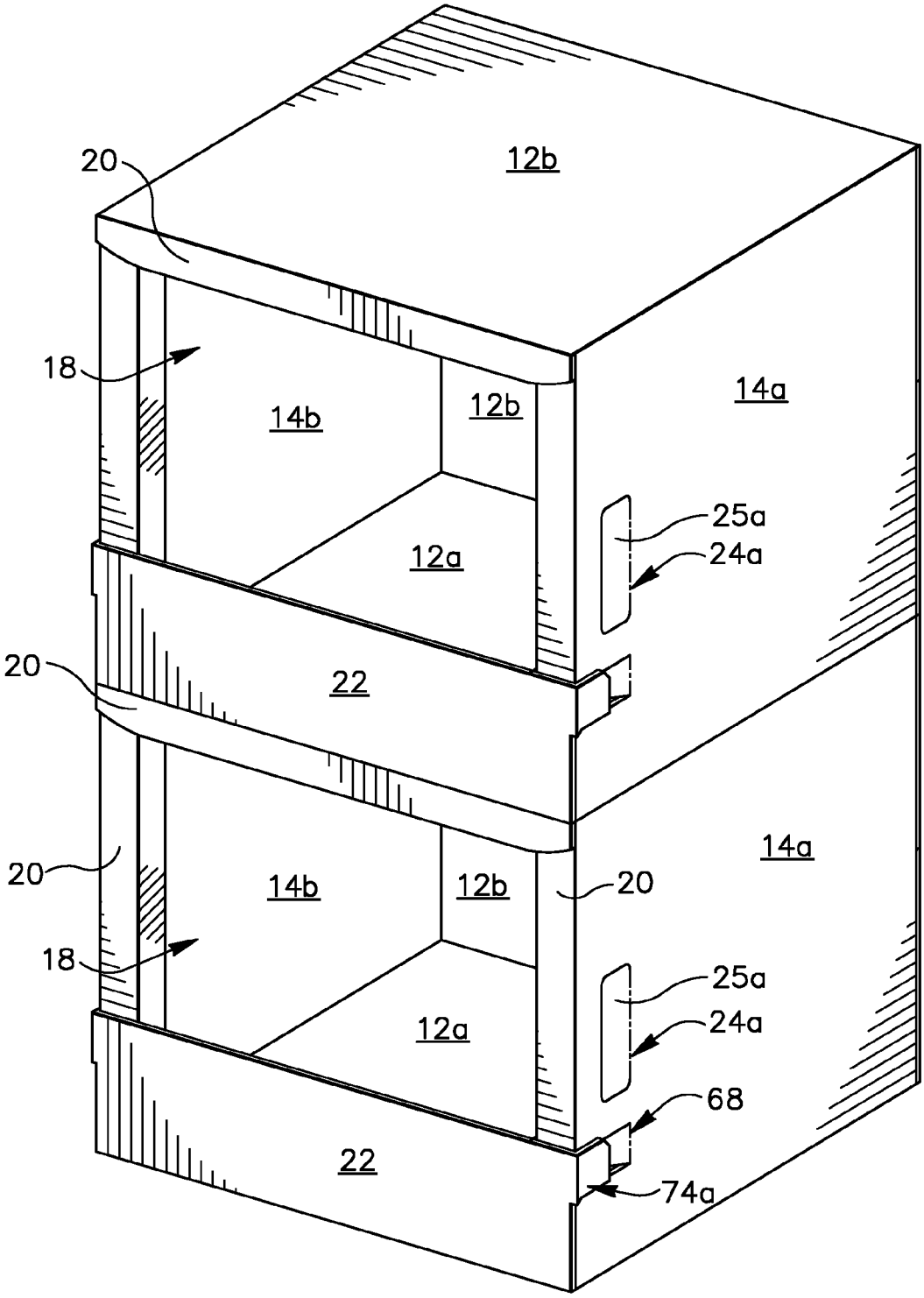
FIG. 2 is a perspective view of two identical shipping and displaying containers of the type shown FIG. 1 and illustrating the two containers in displaying and stacking positions.
Figure 8A:
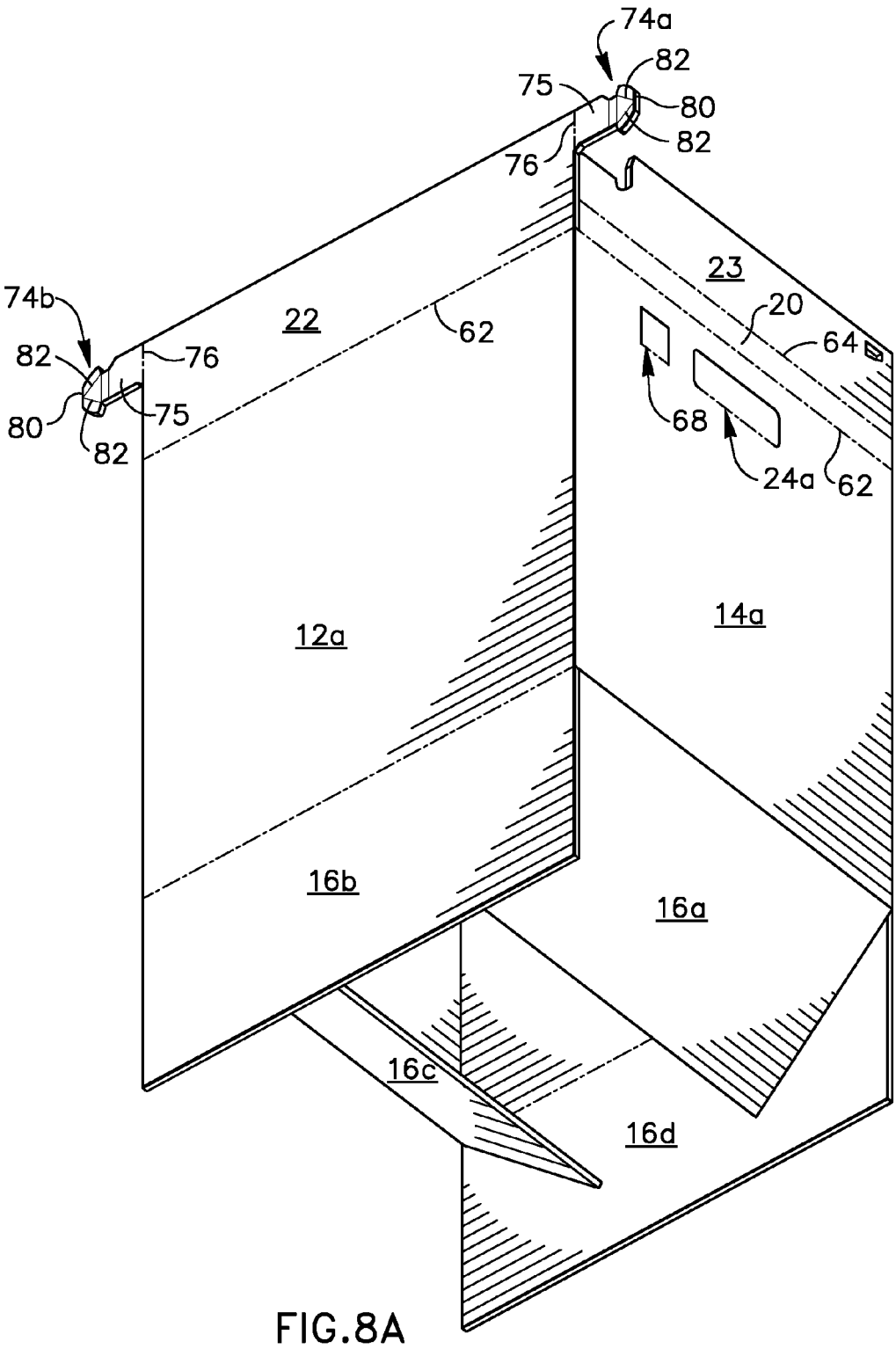
FIGS. 8A through 8E illustrate the folding sequences of the blank shown in FIG. 7B for constructing the shipping and display container in accordance to the first embodiment of the present invention.

FIG. 1 is a top perspective view of a frame face or open-top shipping and displaying container 10 according to a first embodiment of the present invention. The container 10 includes side walls 12*a*, 12*b*, end walls 14*a*, 14*b*, and a bottom wall 16 that are all integrally attached to one another. The container 10 has an open top or opening 18. Although the container 10 is characterized as having side walls and end walls, but one of the ordinary skilled in the art would appreciate that the end walls can be defined as side walls as well and the characterization of the side walls and end walls have no effect on the function or utility of the container 10. The open-top container 10 includes shoulders 20 that provide bearing surface for the next container on top of it when the containers 10 are stacked on one another in shipping position. The frame face shipping and displaying container 10 also includes a bumper sticker panel 22 that is used to partially prevent products from falling out when the container 10 is in display position as depicted in FIG. 2. Moreover, the bumper sticker panel 22 is also used to provide a place for application of the indicia and/or advertising label. Two handhold openings 24*a*, 24*b* are formed on the respective end walls 14*a*, 14*b* to facilitate handling of the container 10. Each handhold 24*a*, 24*b* includes a respective hinge tab 25*a*, 25*b* as will be discussed in greater detail herein below. Bottom wall flaps 16*a*, 16*b*, 16*c*, and 16*d* (shown in FIG. 8A) are foldably joined to bottom edges of the side walls and are folded inwardly therefrom into overlapping relationship with one another to form a bottom wall closure 16. A respective plurality of triangularly-shaped beams foldably joined to upper edges of the respective plurality of side walls. Each of the plurality of the triangularly-shaped beams is defined by a shoulder panel 20 and a flange panel 21, 22, 23, and 25 foldably joined to one another. The bumper sticker panel 22 is foldably joined to upper edge of one of the plurality of side walls forming a partial top closure when the open-top container is in the shipping position.

FIG. 2 is a perspective view of two identical shipping and displaying containers 10 of the type shown FIG. 1 and illustrates the two open-top containers in stacking and display positions. It should be noted that the open-top container 10 in FIG. 1 is rotated 90 degree to be in display position.

Figure 3:
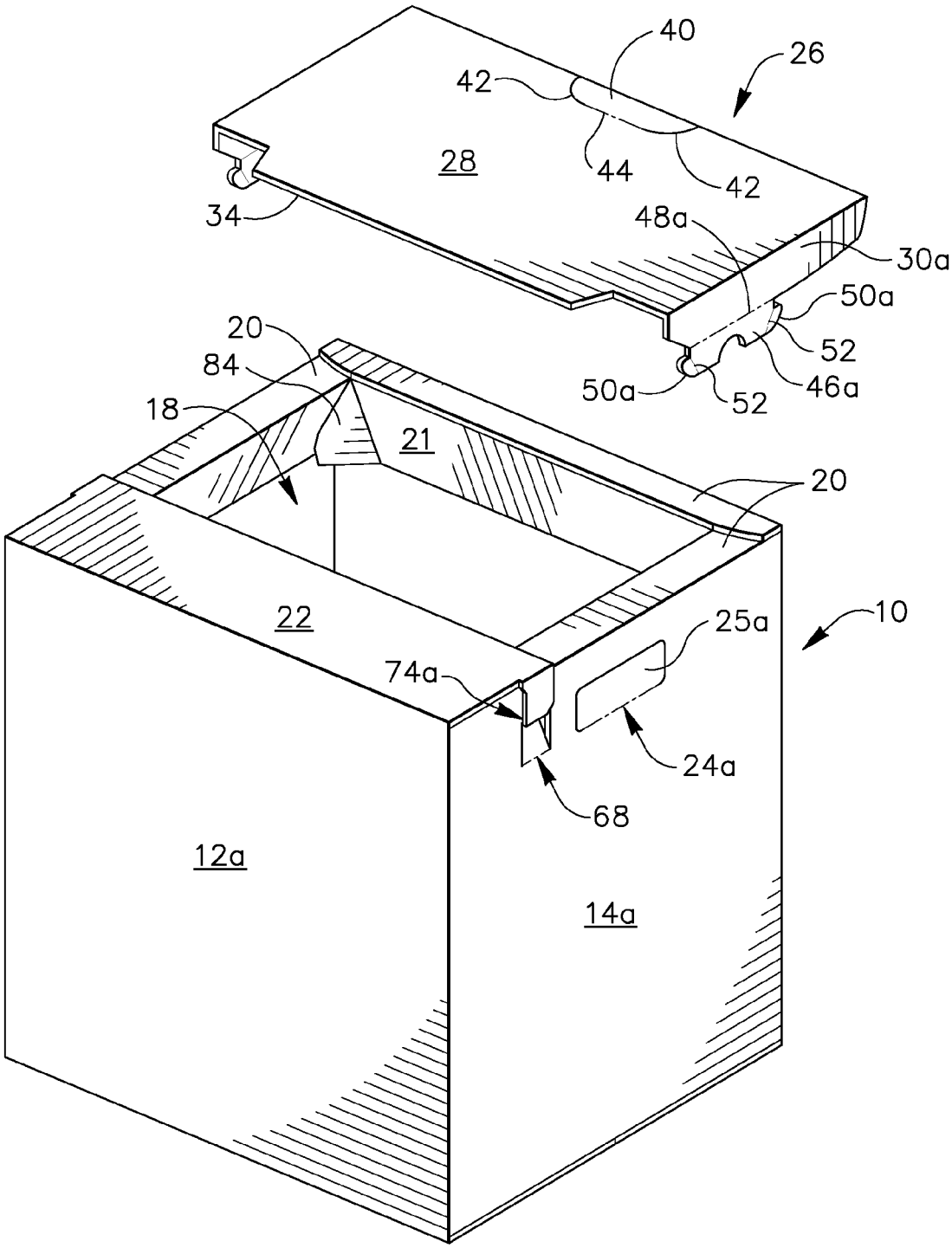
FIG. 3 is an exploded perspective view of the shipping and display container of FIG. 1 and a top plug panel positioned in spaced relationship with respect to the container.
Figure 4:
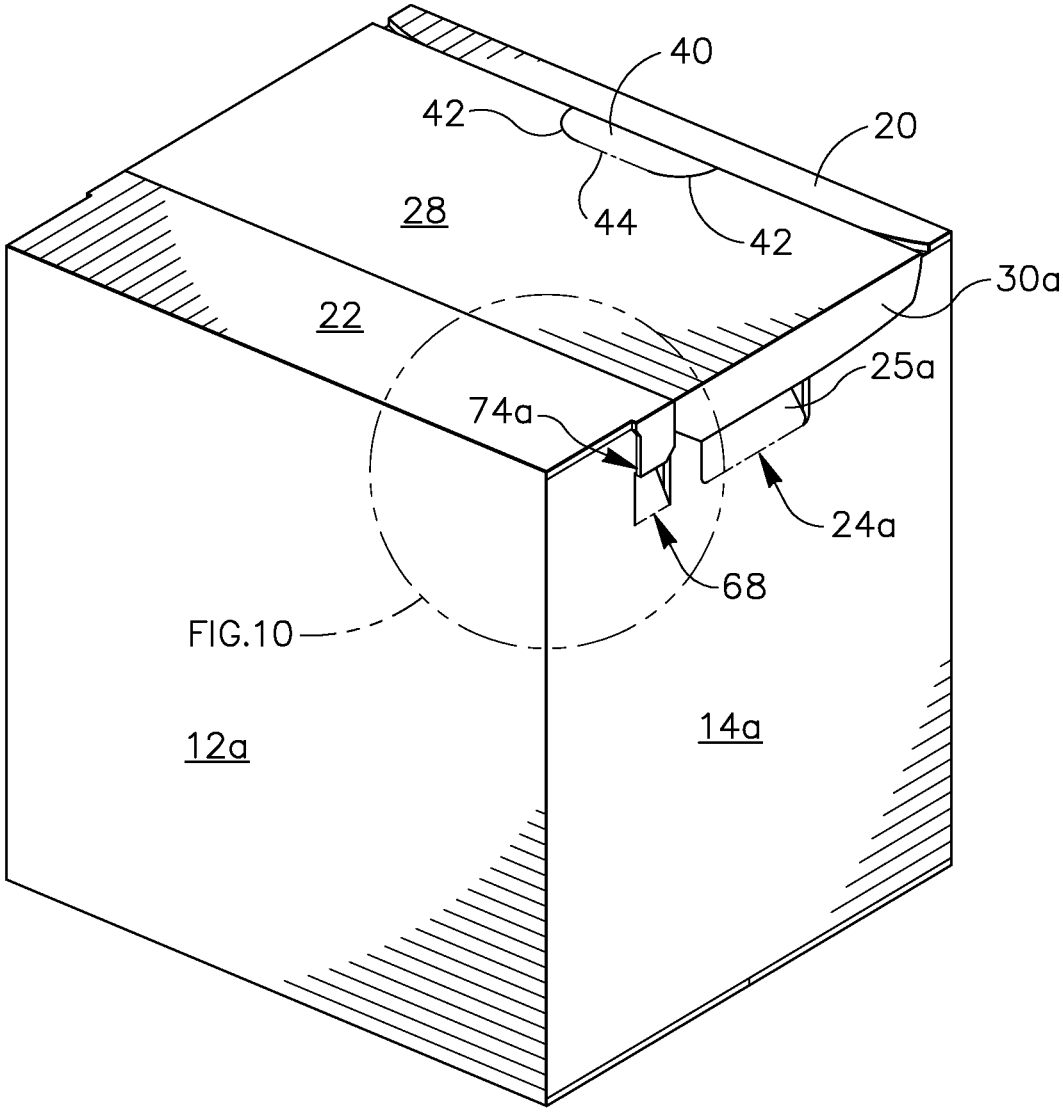
FIG. 4 is similar to FIG. 3, illustrating the shipping and display container is enclosed by the top plug panel.
Figure 6:
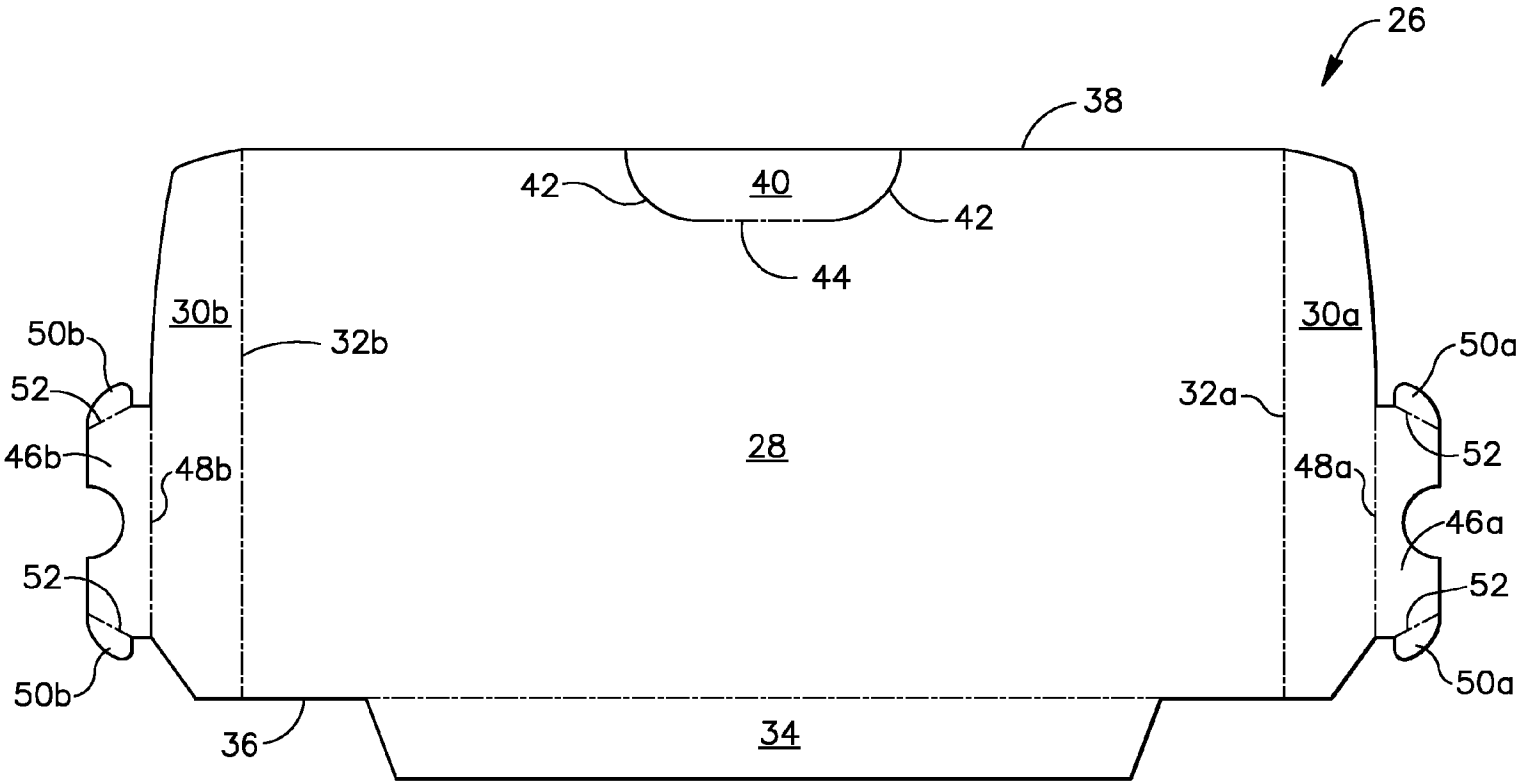
FIG. 6 is a plan view of a blank B2 used to form the top plug panel depicted in FIG. 4.

FIG. 3 is an exploded perspective view of the shipping and displaying container 10 of FIG. 1 having a top plug panel 26 positioned in spaced relationship with respect to the container 10. The top plug panel 26 is sized to cover the open-top or opening 18 of the container 10. The top plug panel 26 includes a central panel 28 and two lateral flaps 30*a*, 30*b* defined by respective fold lines 32*a*, 32*b*. The central panel 28 further includes an extension tab 34 projected outwardly from a longitudinal edge 36 and a pulling section 40. The pulling section 40 has two arc-like slits 42 and a light score line 44 so that the pulling section can be easily folded. Each of the lateral flaps 30 *a*, 30*b* has a pair of first detachable latch tabs 46*a*, 46*b* defined by cut lines 48*a*, 48*b*. Each of the first detachable latch tab 46*a*, 46*b* has a pair of ears 50*a*, 50*b* defined by a respective partial cut line 52 as best shown in FIG. 6. To enclose the container 10, the top plug panel 26 is position onto the opening 18 by inserting the extension tab 34 underneath of the bumper sticker panel 22 and the respective first detachable latch tab 46*a*, 46*b* are inserted into the respective handhold openings 24*a*, 24*b* such that the respective hinge tab 25*a*, 25*b* securely hold in place the respective ears 50*a*, 50*b* as best depicted in FIG. 4.

Figure 5:
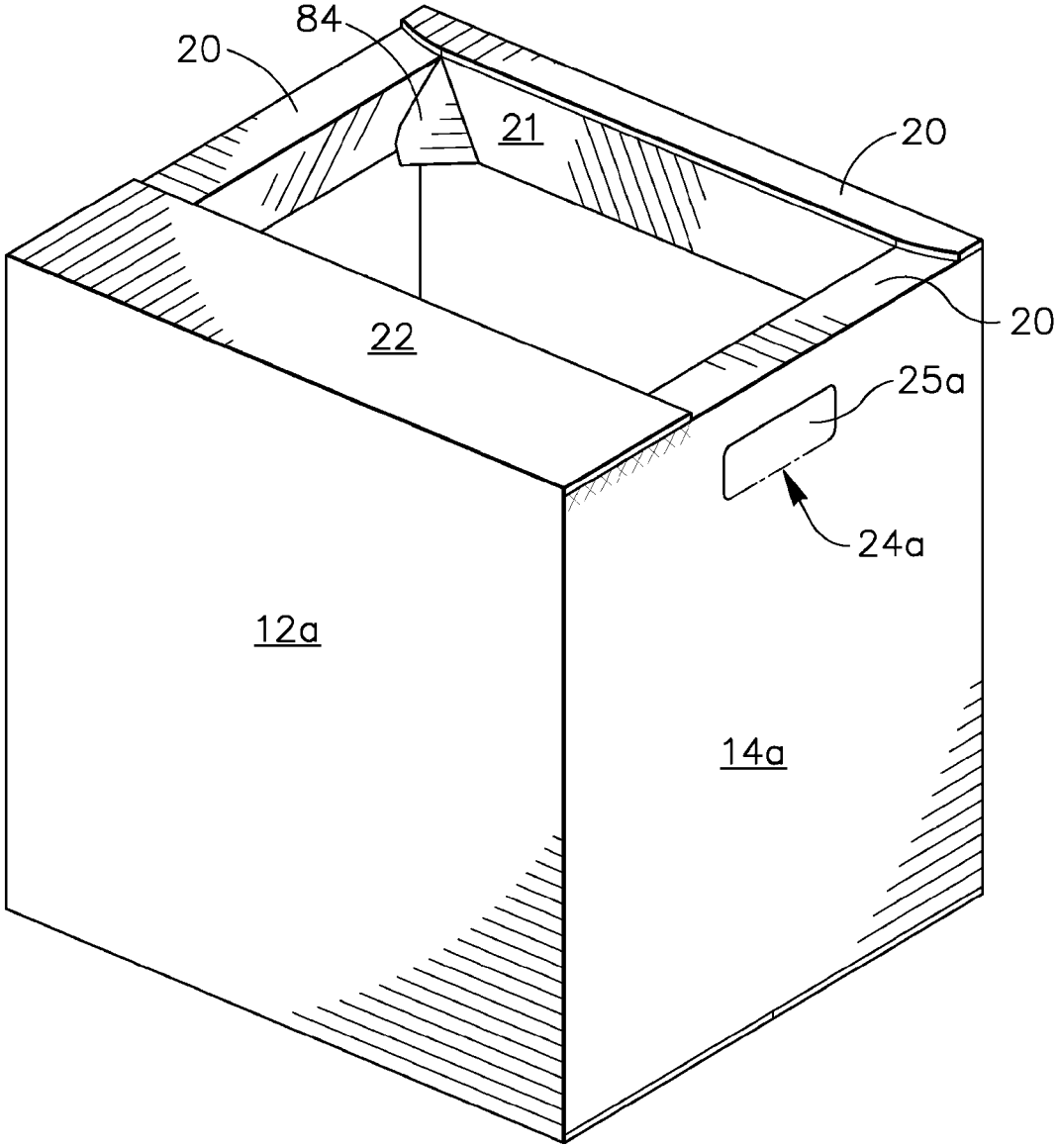
FIG. 5 is a top perspective view of alternative shipping and display container according to a second embodiment of the present invention.

FIG. 5 is a top perspective view of alternative shipping and displaying container 10 according to a second embodiment of the present invention. In this embodiment, the bumper sticker panel 22 is held in position by a means other than the straps off of its sides. The means may include adhesive and tape or an extension of the bumper sticker decal itself.

Figure 7A:
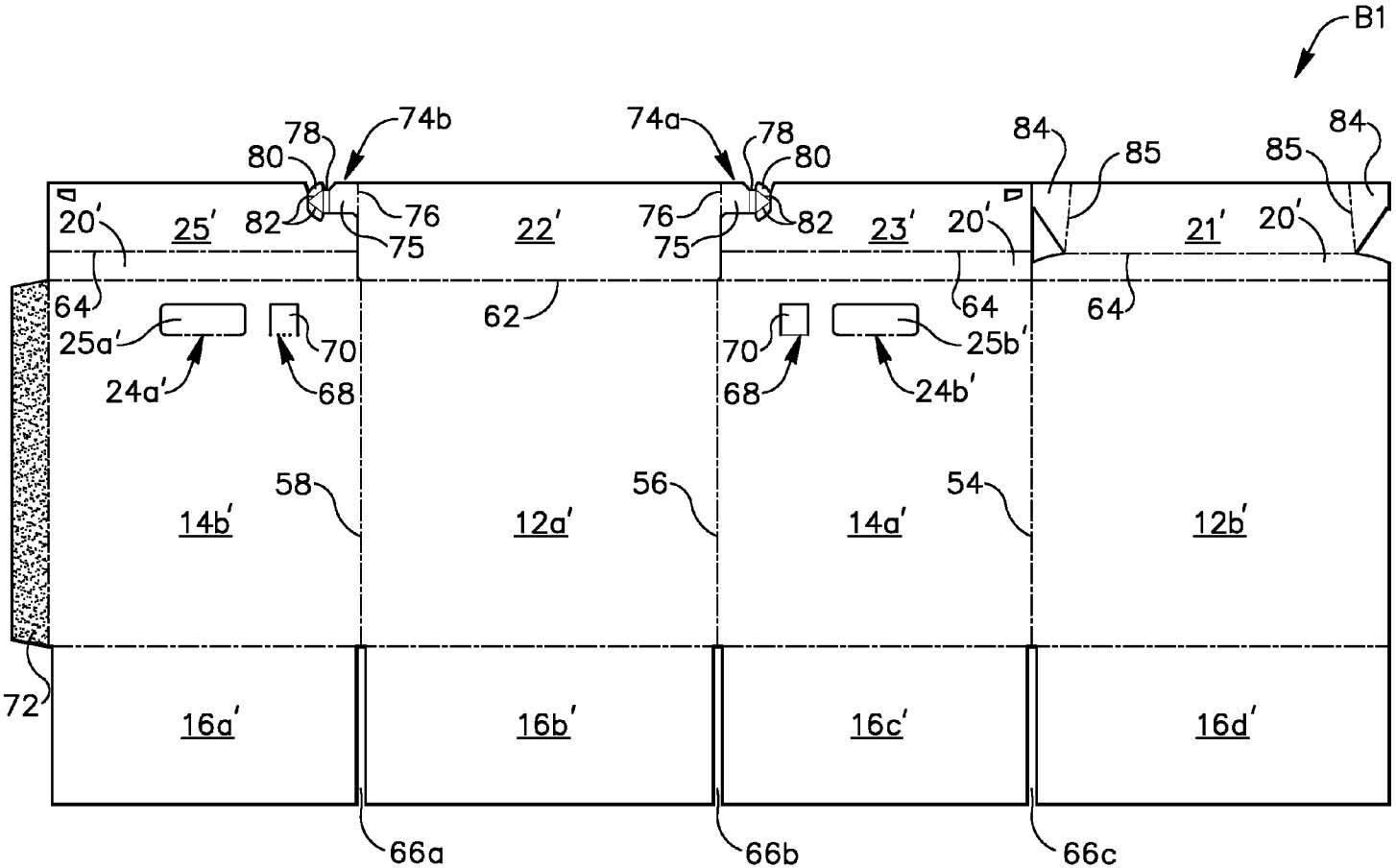
FIG. 7A is a plan view of a blank B1 used to form the shipping and display container shown in FIG. 1 in accordance to the first embodiment of the present invention.
Figure 7B:
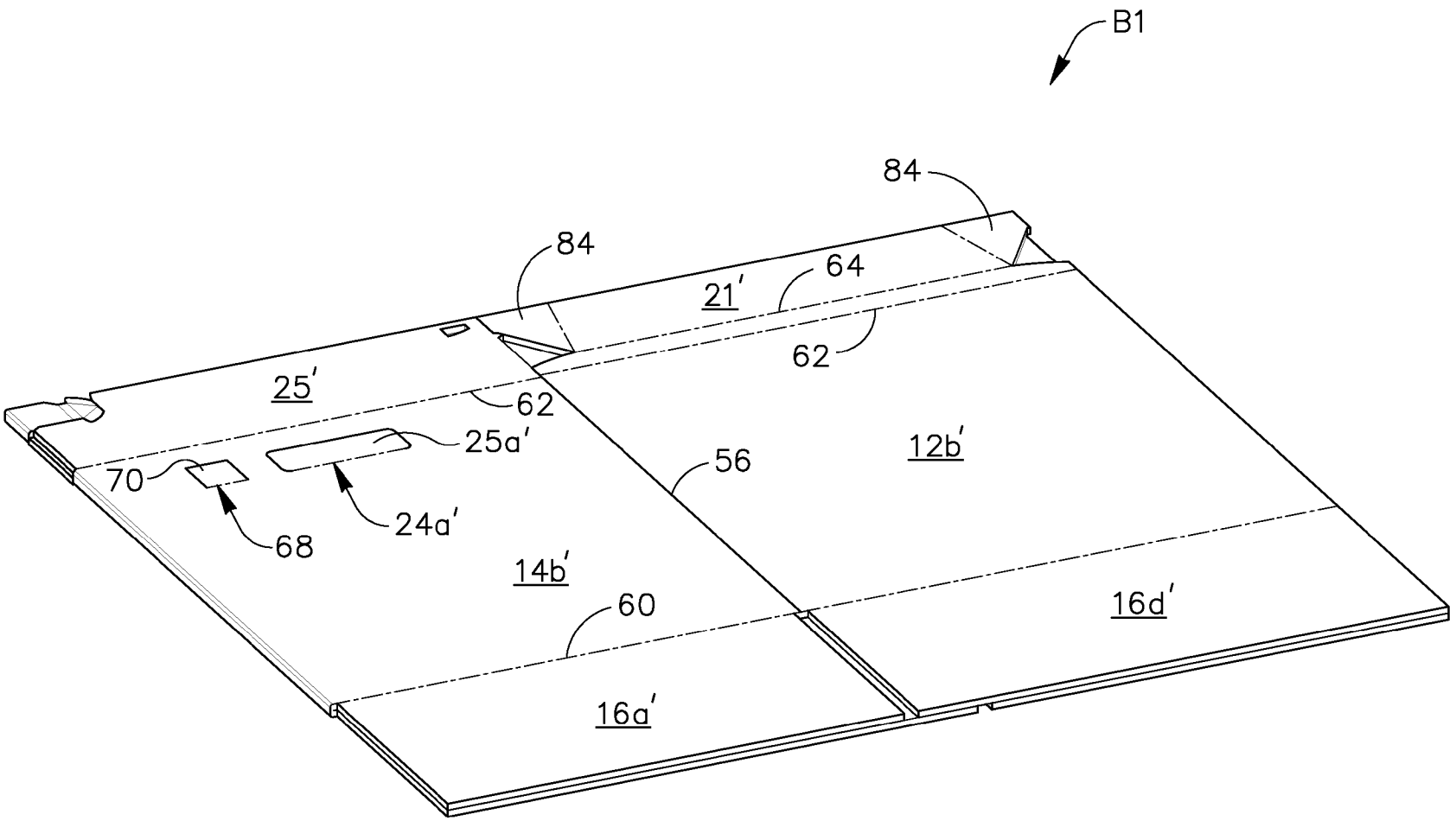
FIG. 7B is a top perspective view of the blank B1 in FIG. 7A, showing a first step used to form the shipping and display container shown in FIG. 1, wherein one edge of the side walls is attached to the glue area.

FIG. 7A is a plan view of a blank B1 used to form the shipping and displaying container 10 shown in FIG. 1 and FIG. 7B is a top perspective view of the blank B1 in FIG. 7A, showing a first step used to form the shipping and displaying container 10 shown in FIG. 1, wherein one edge of the side walls is attached to the glue panel 72. The blank B1 is substantially flat symmetrical with respect to its longitudinal axis thereof. The blank B1 is preferably an integral piece of a material such as continuous sheet of conventional corrugated cardboard. The blank B1 is cut along its outer margins to form its specific shape. The blank B1 is divided into side wall panels 12*a*', 12*b*' and end wall panels 14*a*', 14*b*' by three transverse parallel fold lines 54, 56, and 58. Upon folding, the side wall panels 12*a*', 12*b*' and end wall panels 14*a*', 14*b*' form the respective side walls 12*a*, 12*b* and the end walls 14*a*, 14*b*, respectively. As noted hereinabove, the end walls and the side walls can be defined as plurality of side walls. The blank B1 is also divided by two parallel longitudinal parallel fold lines 60, 62 perpendicular to transverse fold lines 54, 56, and 58, although longitudinal fold lines 60, 62 may be oriented at some angle relative to one another or relative to transverse fold lines 60, 62. The longitudinal fold line 60 and the three transverse parallel fold lines 54, 56, and 58 define four bottom panels 16*a*', 16*b*', 16*c*', and 16*d*' which upon folding form the bottom wall 16 of the container 10.

Slots 66*a*, 66*b*, and 66*c* are cut into the first blank B1 between bottom panels 16*a*', 16*b*, 16*c*', and 16*d*', respectively. The slots are formed to facilitate the folding of the four bottom panels 16*a*', 16*b*', 16*c*', and 16*d*'. Each of the end wall panels 14*a*', 14*b*' includes a respective shoulder 20' that is formed by the parallel fold lines 62 and 64. Each of the end wall panels 14*a*', 14*b*' includes a respective first and second triangularly-shaped beams 23' and 25'. Each of the end wall panels 14*a*', 14*b*' includes a can-lock aperture 68 having a latch tab 70. The end panel 14*b*' further includes a glue flap 72 which is used to be attached to the side wall panel 12*b*'. The side wall panel 12*a*' includes the bumper sticker panel 22' defined by the fold line 62. The bumper sticker panel 22' includes two identical can-lock tabs 74*a*, 74*b* defined by fold lines 76. Each can-lock tab 74*a*, 74*b* includes a strap 75 defined by fold lines 76 and 78 and an ear 80. The ear 80 has two angled fold lines 82 which permit the tip of the ear 80 be bent to easily inserted into the can-lock aperture 68. The side wall panel 12*b*' includes a third hypotenuse flange 21'. The third triangularly-shaped beam 21' has two identical shoe-shaped latches 84' at the lateral opposed ends. The shoe-shaped latches 84' are slightly folded along fold line 85 when they are in folded position. The shoe-shaped latches 84' permit the shoulders 20 and first, second, and third triangularly-shaped beam 23', 25', 21' in their folded position when the blank B1 is constructed to form the container 10. In the first step of folding sequences, blank B1 is folded so that the glue panel 72 is attached to the side wall panel 12*b*' as best shown in FIG. 7B.

FIGS. 7A and 7B illustrate the folding sequences of the blank B1 for constructing shipping and displaying container 10 in accordance to the first embodiment of the present invention. It should be noted that the proper size and configuration of these panels are important to construct into side and end panels that are brought into juxtaposition with one another to form the shipping and displaying container 10. In the first step of the folding sequences, end wall panel 14*b*' is folded onto the side wall panel 12*a*' along the fold line 58 and the side wall panel 12*b*' is folded onto the end wall panel 14*a*' along the fold line 54. Next, the glue flap 72 is glued to the longitudinal edge of the side wall panel 12*b*'.

Figure 8B:
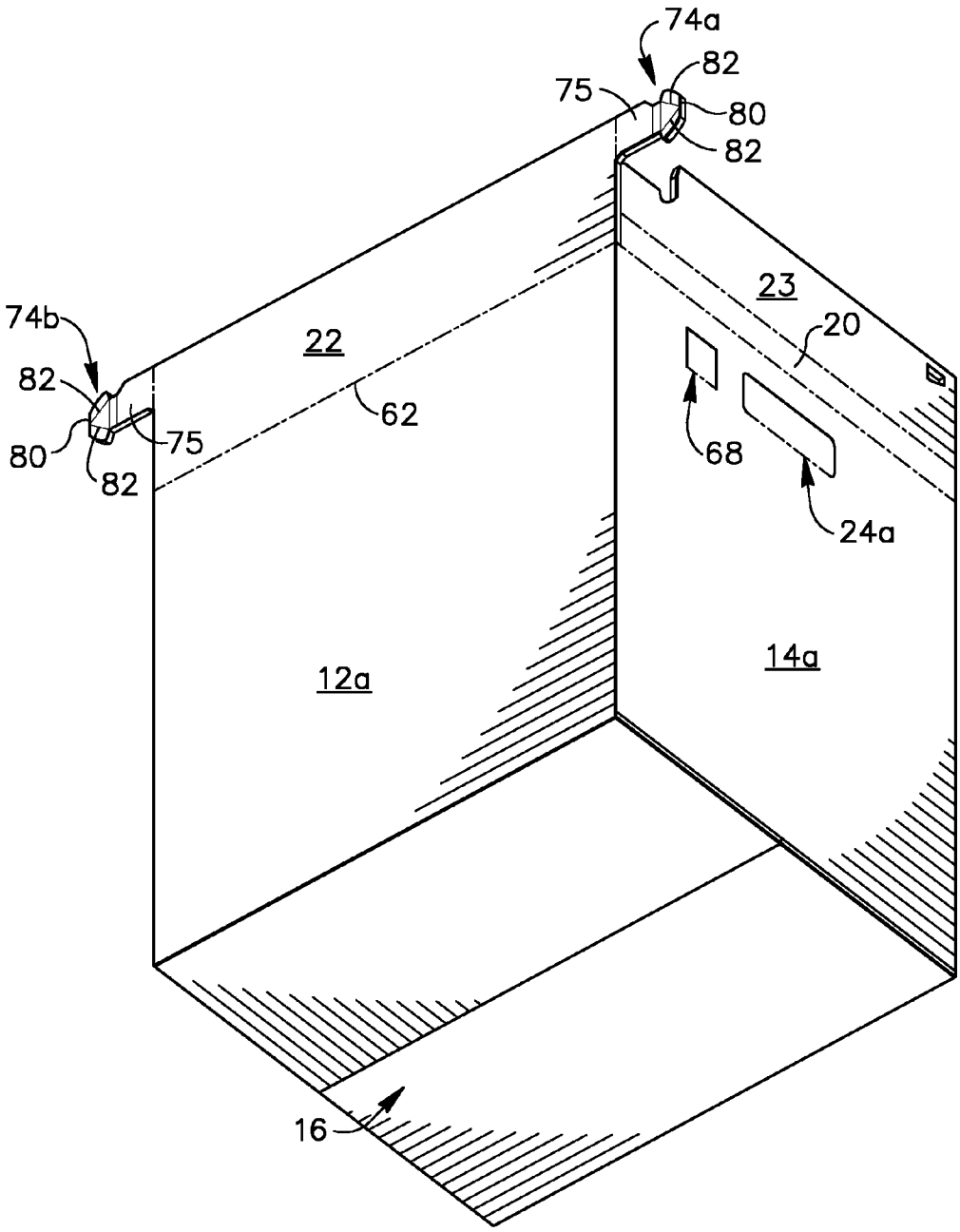
Figure 8C:
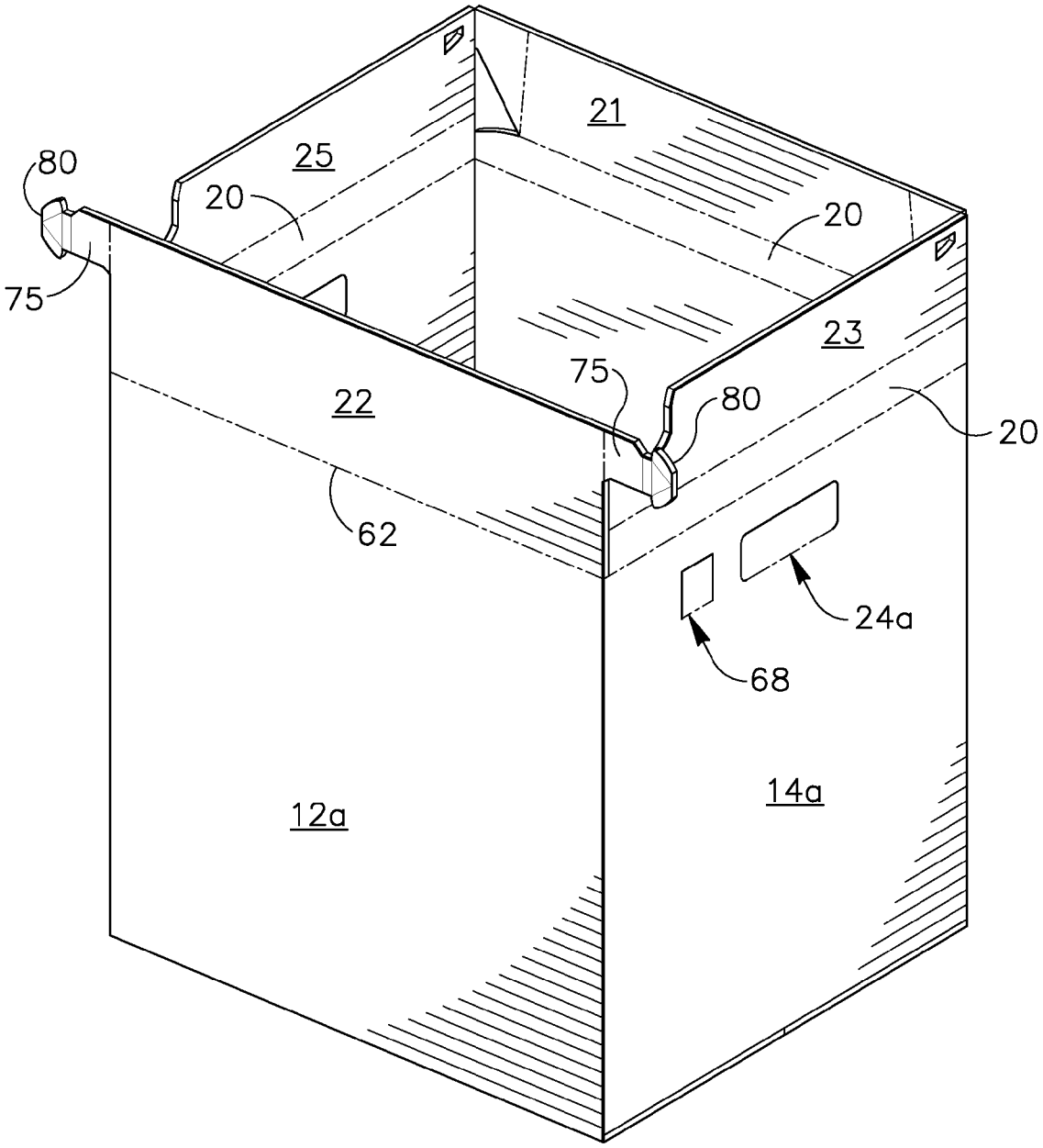
Figure 8D:
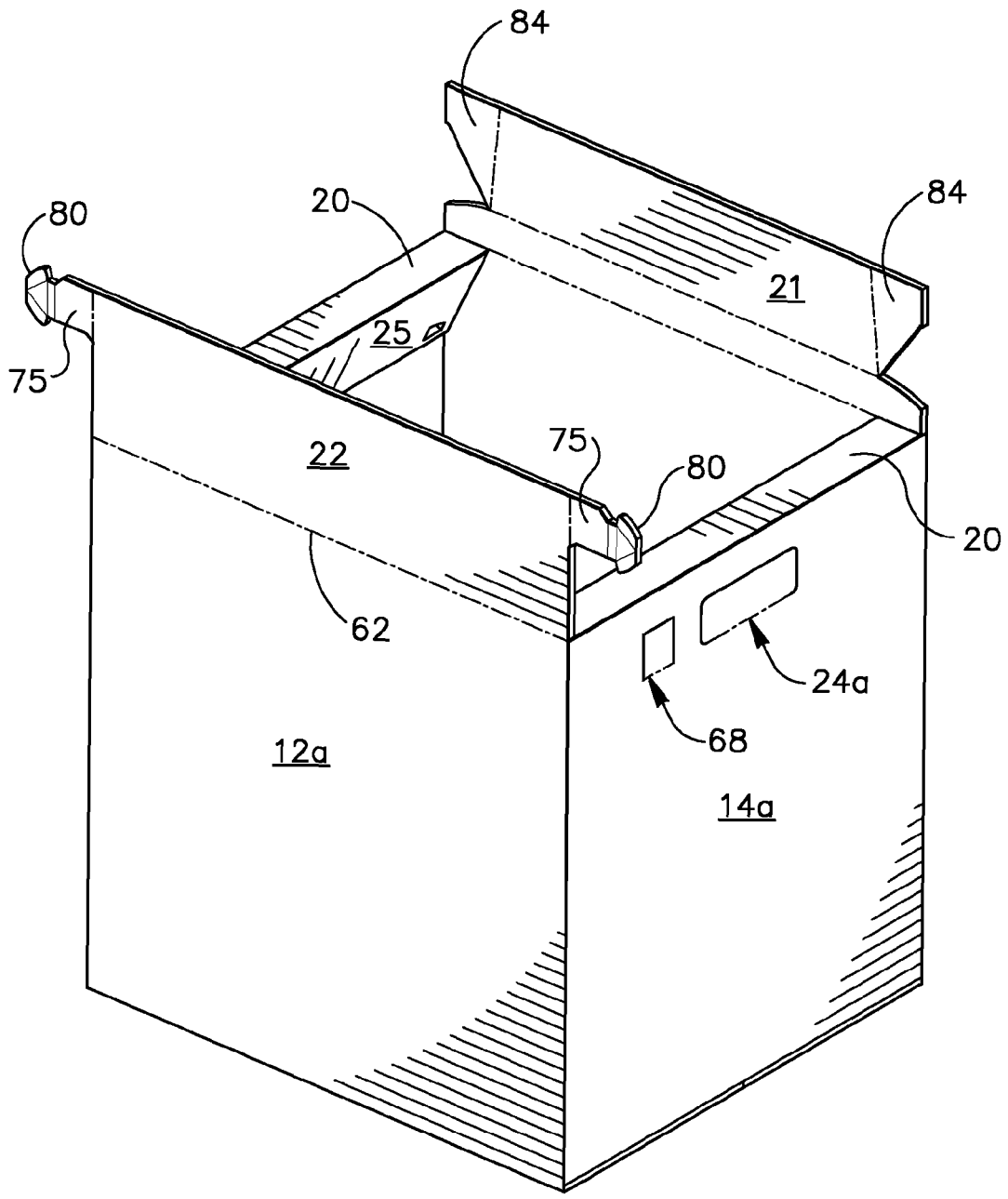
Figure 8E:
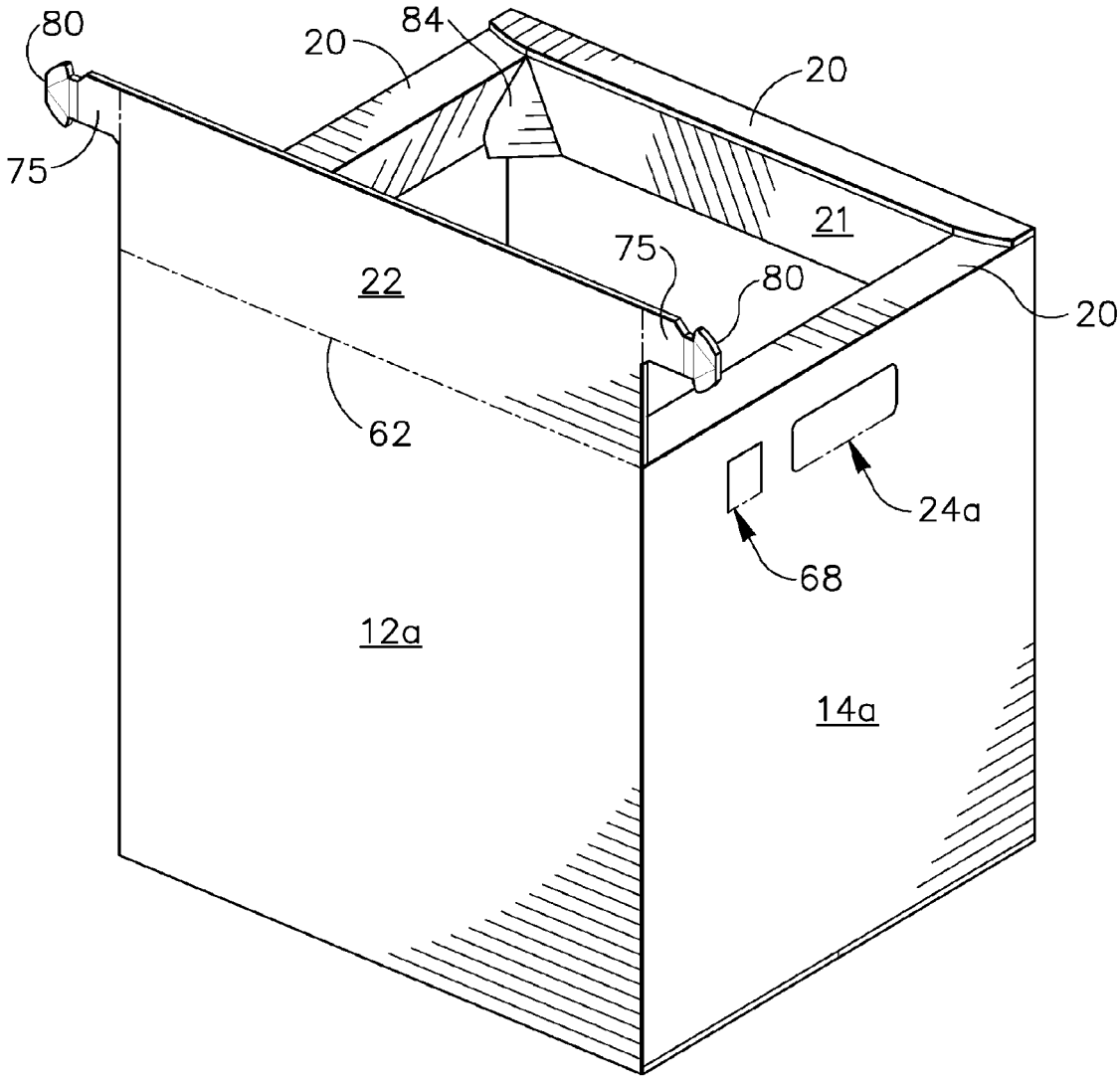
Figure 9:
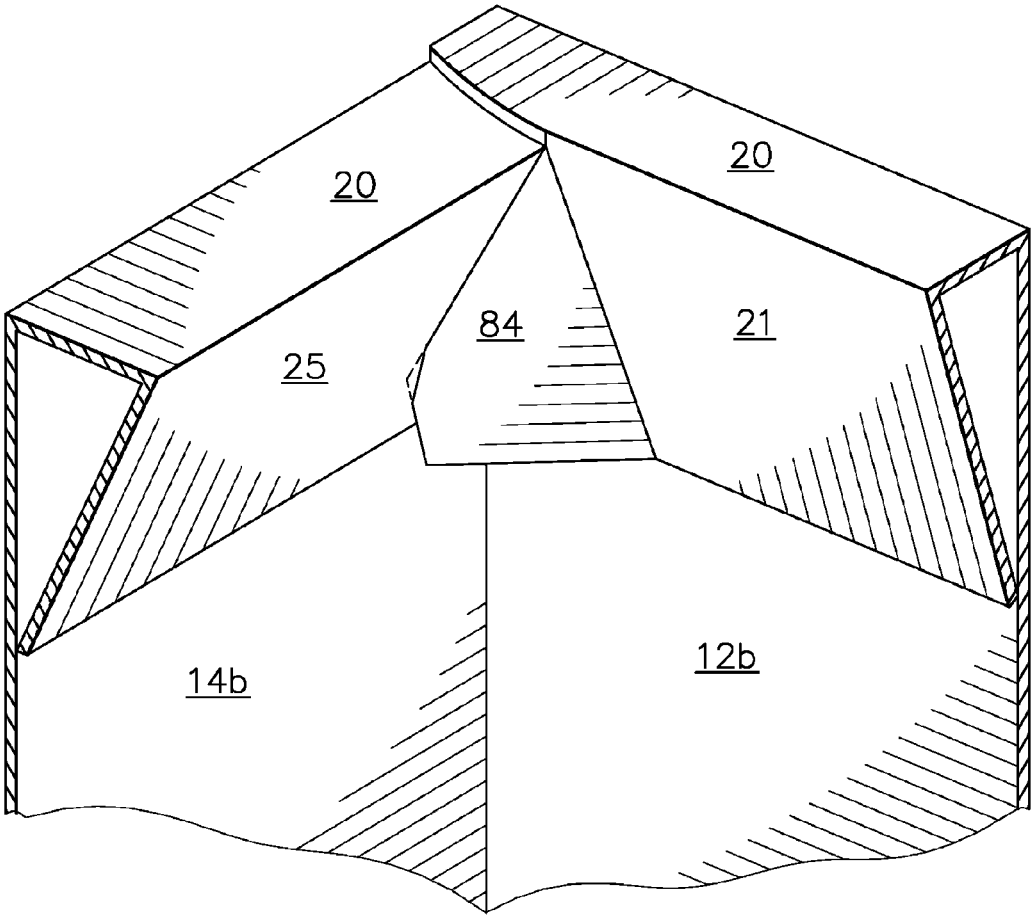
FIG. 9 is an enlarged view of a cut away portion of the shipping and display container shown in FIG. 8E illustrating a corner portion of the container.
Figure 10:
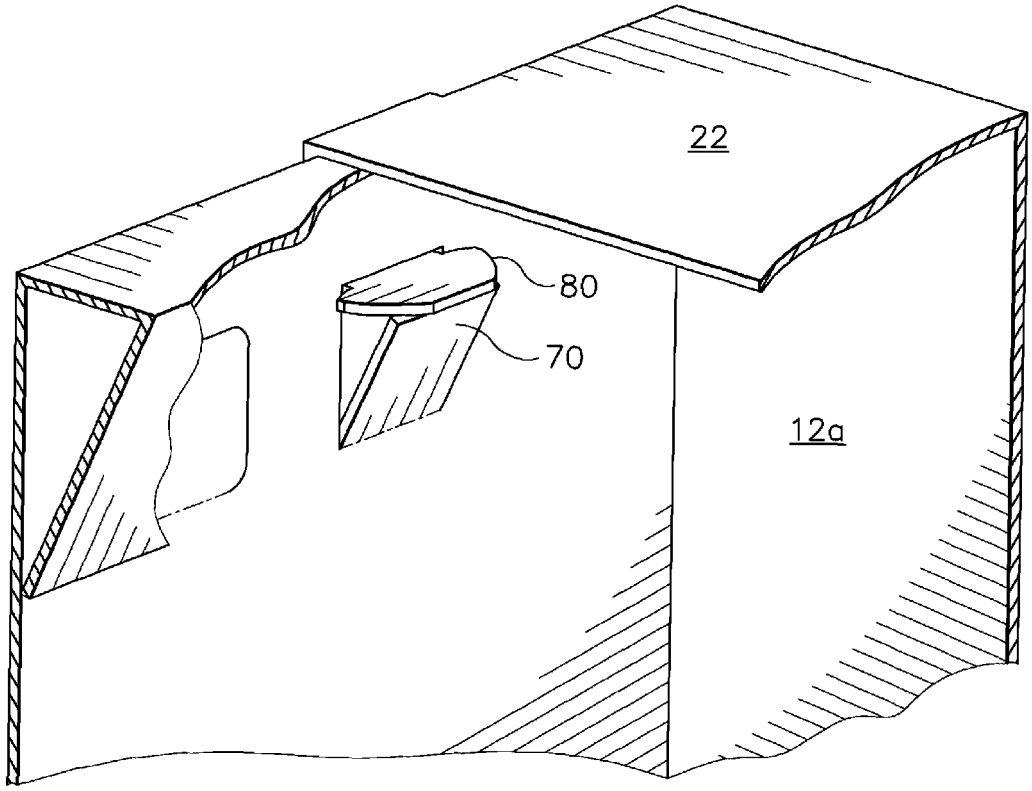
FIG. 10 is an enlarged view of a cut away portion of the shipping and displaying container shown in FIG. 8E illustrating the manner in which the can-lock tab and the tab latch engaged with one another.

Referring to FIGS. 8A-8E, manual set-up of the shipping and displaying container 10 is easily accomplished. However, an ordinary skilled in the art would appreciate that generally a folding machine alternatively performs the forming operations. After the first step of folding as described with respect to the FIGS. 7A and 7B, the blank B1 is erected to a position depicted in FIG. 8A. Next, the bottom panel 16*a* and 16*c* are brought into juxtaposition and the bottom panels 16*b*, 16*d* are also brought into juxtaposition and glued to the bottom panel 16*a*, 16*c*. Alternatively, once the bottom panels 16*b*, 16*d* are also brought into juxtaposition, they can be enclosed the bottom wall 16 by glue tape as depicted in FIG. 8B. Next, the first and second triangularly-shaped beams 23 and 25 are folded so that the shoulders 20 are formed and then the third triangularly-shaped beam 21 is folded so that the latches 84 hold the first and second triangularly-shaped beam 23 and 25 in the folded positions as best shown in FIG. 9. Next, the bumper sticker panel 22 is folded 90 degrees to rest on the shoulders 20. Finally, to keep the bumper sticker panel 22 in folded position, the can-lock tabs 74*a*, 74*b* are inserted into the can-lock aperture 68 by slightly folding the tip of the ears 80 so that they fit into respective can-lock aperture 68 and locked therein by the latch tab 70 as best depicted in FIG. 10.

In use, after products such as poultry or the like are disposed in the container, as an alternative generally for shipping purposes, the top plug panel 26 covers the opening 18. As best depicted in FIG. 4, the top plug panel 26 is secured by inserting the extension tab 34 underneath of the bumper sticker panel 22 and the respective detachable latch tab 46*a*, 46*b* are inserted into the respective handhold openings 24*a*, 24*b* such that the respective hinge tab 25*a*, 25*b* securely hold in place the respective ears 50*a*, 50*b*. To open the container 10, the pulling section 40 is snapped upwardly so that the top plug panel 26 is permanently detached from the container 10 along the cut lines 48*a* and 48*b*. Then the container 10 can be rotated 90 degrees to be placed in display position.

FIG. 9 provides a cross section of the shoulders and the triangularly-shaped beam discussed above. The shoulder portion of a triangle shaped (delta) beam that in "shipping" position provides a bearing surface for the next container set on top of it. However, in the display position, it provides the short leg of the delta-beam type structure for the "Front" of the display, to support the next container set on top of it (these beams are intentionally stronger than the "Back" (RSC panels) of the container) in order to counteract the tipping-forward forces created when a bag of product is yanked out the front, and assure that if there is stacking failure in this display position, that the container will tend to fail toward the back, away from the consumer.

The flange portion of the Frame Face-locking delta beam has three purposes. First, as a triangularly-shaped or delta beam across the top (display position), it prevents top sag. Second, it helps ramp product out of the opening. Third, and most importantly, at each end it carries the triangular-shaped Frame Face latches 84 that both lock it up against the top of the container, and at the same time locks both flanges 23 and 25 into their final positions.

It should now be appreciated that the present invention provides a material-saving, quickly erected carton especially useful in retaining, transporting variety of products such as poultry or meat, by way of example. The shipping and displaying container 10 is designed with first, second and third triangularly-shaped beams and a bumper sticker panels to securely hold the container in shipping as well as display position. As described above, the structure of the end panels, the side panels with the first, second and third hypotenuse flanges and the bumper sticker panels enhance the rigidity, stackability, venting capability and manufacturing cost effectiveness of the shipping and displaying container. The blank used to form the shipping and displaying container has a symmetrical design, which reduces erecting and closing labor. The lay flat design of the blank speeds the cutting and packaging process and facilitates easy shelving.

In sum, one aspect of the present invention is directed to an open-top container for shipping and displaying products which comprises a plurality of side walls. Bottom wall flaps are foldably joined to bottom edges of the side walls and are folded inwardly therefrom into overlapping relationship with one another to form a bottom wall closure. A respective plurality of triangularly-shaped beams foldably joined to upper edges of the respective plurality of side walls. Each of the plurality of the triangularly-shaped beams is defined by a shoulder panel and a flange panel foldably joined to one another. A bumper sticker panel is foldably joined to upper edge of one of the plurality of side walls forming a partial top closure when the open-top container is in the shipping position and partially prevents products from falling out when the open-top container is in the displaying position.

A top plug panel is used to enclose the open-top container when the open-top container is in the shipping position. The top plug is defined by a central panel having an extension tab and pulling section formed on respective opposed longitudinal edges thereof. A pair of first detachable latch tabs extend outwardly from opposed lateral edges the central panel. The plurality of side walls further comprises a pair of handhold openings, each of which is formed in opposed plurality of side walls and each includes a hinge tab. The respective pair of first detachable latch tabs is engaged with the respective hinge tabs to securely hold the top plug onto the open-top container.

The plurality of side walls further comprises a pair of can-lock apertures, each of which having a second latch-tabs. The bumper sticker panel includes a pair of identical can-lock tabs, each of which is defined by a strap and an ear. Each of the pair of identical can-lock tabs is inserted into the respective can-lock apertures and locked therein by the respective second latch-tabs. The bumper sticker panel is attached to the shoulder panels when forming the partial top closure. The plurality of triangularly-shaped beams and the bumper sticker panel in a tandem arrangement provide a bearing surface for another open-top container to stacked on one another.

Another aspect of the present invention is directed to a shipping and displaying container formed from a one-piece unitary blank of material. The shipping and displaying container comprises a bottom wall, first and second side walls, first and second end walls which all foldably joint with one another. First and second triangularly-shaped beams are foldably joined to upper edges of the respective first and second end walls. Each of the first and second triangularly-shaped beams is defined by a shoulder panel and a flange panel foldably joined to one another. A third triangularly-shaped beam having a pair of shoe-shaped latches foldably joined to upper edge of the second side wall. The pair of shoe-shaped latches foldably joined at lateral opposed ends of the third triangularly-shaped beam to lock and hold the first, second, and the third triangularly-shaped beams into their respective folding position. A bumper sticker panel is foldably joined to upper edge of the first side wall forming a partial top closure when the container is in the shipping position and partially prevents products from falling out when the container is in the displaying position.

A further aspect of the present invention is directed to a blank for making an open-top container comprises a plurality of side wall panels foldably joined together along adjacent side edges. One of the plurality of side wall panels includes a foldably joined glue panel adapted to form the side walls in opposed relationship to one another in an open-top container erected from the blank. A plurality of bottom wall flap panels are foldably joined to bottom edges of the side wall panels, the bottom wall flap panels adapted to be folded inwardly to form a bottom wall closure in an open-top container erected from the blank. First cut lines form in two of the plurality of the side walls at respective upper edges thereof, defining first punch-out panels that can be pushed inwardly to form respective handhold openings. A plurality of top wall flap panels divided by traverse fold lines foldably joined to lateral edges of the plurality of the side walls. The plurality of top wall flap panels form into first, second, third triangularly-shaped beams, and a bumper sticker panel in a container erected from the blank. Additional cut lines form in the two of the plurality of the side walls, defining can-lock aperture punch-out panels contiguous with the first punch-out panels.

Numerous modifications and variations on the present invention are possible in light of the above teachings. It is, therefore, to be understood that within the scope of the accompanying claims, the invention may be practiced otherwise than as specifically described herein.

It should be understood that fold lines and score line as used herein may be used interchangeably so long as the function of the line is not destroyed.

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An open-top container for shipping and displaying products comprising:

a plurality of side walls;

bottom wall flaps foldably joined to bottom edges of the side walls and folded inwardly therefrom into overlapping relationship with one another to form a bottom wall closure; and a respective plurality of triangularly-shaped beams foldably joined to upper edges of three of the respective plurality of side walls wherein each of the plurality of the triangularly-shaped beams being defined by a shoulder panel and a flange panel foldably joined to one another; and a bumper sticker panel foldably joined to upper edge of one of the plurality of side walls forming a partial top closure when the container is in a shipping position and partially prevent products from falling out when the container is in a displaying position wherein the bumper sticker panel includes a pair of identical can-lock tabs extend outwardly from lateral edges thereof and wherein each of the can-lock tabs is defined by a strap and an ear.

2. The open-top container of claim 1 further comprising a top plug panel used to enclose the open-top container when the open-top container is in the shipping position.

3. The open-top container of claim 2 wherein the top plug panel is defined by a central panel having an extension tab projected outwardly from one longitudinal edge and pulling section formed on the opposed longitudinal edge thereof and a pair of first detachable latch tabs extend outwardly from opposed lateral flaps edges of the central panel.

4. The open-top container of claim 1 wherein the plurality of side walls includes a pair of handhold openings, each of which, formed in the plurality of side walls and each includes a hinge tab.

5. The open-top container of claim 3 wherein each of the of first detachable latch tabs is engaged with each of the hinge tab to securely hold the top plug panel onto the open-top container.

6. The open-top container of claim 1 wherein one of the plurality of triangularly-shaped beams includes a pair of shoe-shaped latches foldably joined at lateral opposed ends thereof to lock the plurality of triangularly-shaped beams into their respective folding position.

7. The open-top container of claim 1 wherein the plurality of side walls includes a pair of can-lock apertures, each of which having a latch-tab.

8. The open-top container of claim 7 wherein each of the identical can-lock tabs is inserted into the respective can-lock apertures and locked therein by each of the respective latch-tab.

9. The open-top container of claim 1 wherein the bumper sticker panel is attached to the shoulder panels when forming the partial top closure.

10. The open-top container of claim 1 wherein the plurality of triangularly-shaped beams and the bumper sticker panel in a tandem arrangement provide a bearing surface for another open-top container to be stacked on one another.

11. A shipping and displaying container formed from a one-piece unitary blank of material, the shipping and displaying container comprising:

a bottom wall, first and second side walls, first and second end walls which all foldably joint with one another;

first and second triangularly-shaped beams foldably joined to upper edges of the respective first and second end walls, each of the first and second triangularly-shaped beams being defined by a shoulder panel and a flange panel foldably joined to one another;

a third triangularly-shaped beam having a pair of shoe-shaped latches foldably joined to upper edge of the second side wall, the pair of shoe-shaped latches foldably joined at lateral opposed ends of the third triangularly-shaped beam to lock and hold the first, second, and the third triangularly-shaped beams into their respective folding position; and a bumper sticker panel foldably joined to upper edge of the first side wall forming a partial top closure when the container is in a shipping position and partially prevent products from falling out when the container is in a displaying position and wherein the bumper sticker panel includes a pair of identical can-lock tabs extend outwardly from lateral edges thereof and wherein each of the can-lock tabs is defined by a strap and an ear.

12. The shipping and displaying container of claim 11 wherein each of the first and second end walls includes a can-lock aperture having a latch-tab foldably joined thereto.

13. The shipping and displaying container of claim 11 wherein each of the identical can-lock tabs is inserted into the respective can-lock apertures and locked therein by each of the respective latch-tab.

14. A blank for making an open-top container comprising:

a plurality of side wall panels foldably joined together along adjacent side edges, one of the plurality of side wall panels includes a foldably joined glue panel adapted to form the side walls in opposed relationship to one another in an open-top container erected from the blank;

a plurality of bottom wall flap panels foldably joined to bottom edges of the side wall panels, the bottom wall flap panels adapted to be folded inwardly to form a bottom wall closure in an open-top container erected from the blank;

first cut lines in two of the plurality of the side walls at respective upper edges thereof, defining first punch-out panels that can be pushed inwardly to form respective handhold openings;

a plurality of top wall flap panels divided by traverse fold lines foldably joined to lateral edges of the plurality of the side walls, the plurality of top wall flap panels form into first, second, third triangularly-shaped beams, and a bumper sticker panel in a container erected from the blank and wherein the bumper sticker panel foldably joined to upper edge of one of the plurality of side wall forming a partial top closure when the container is in a shipping position and partially prevent products from falling out when the container is in a displaying position and wherein the bumper sticker panel includes a pair of identical can-lock tabs extend outwardly from lateral edges thereof and wherein each of the can-lock tabs is defined by a strap and an ear.

* * * * *